US007946227B2

(12) United States Patent
Koekemoer et al.

(10) Patent No.: US 7,946,227 B2
(45) Date of Patent: May 24, 2011

(54) DETONATOR SYSTEM

(75) Inventors: Andre Koekemoer, Woodmead (ZA); Albertus Abraham Labuschagne, Woodmead (ZA); Schagen Diederik Van Soelen, Woodmead (ZA); Riaan Lingerfelder Van Wyk, Woodmead (ZA)

(73) Assignee: DetNet South Africa (Pty) Limited, Sandton (ZA)

( * ) Notice: Subject to any disclaimer, the term of this patent is extended or adjusted under 35 U.S.C. 154(b) by 0 days.

(21) Appl. No.: 12/226,374

(22) PCT Filed: Apr. 16, 2007

(86) PCT No.: PCT/ZA2007/000021

§ 371 (c)(1),
(2), (4) Date: Feb. 24, 2009

(87) PCT Pub. No.: WO2007/124517

PCT Pub. Date: Nov. 1, 2007

(65) Prior Publication Data

US 2010/0132576 A1 Jun. 3, 2010

(30) Foreign Application Priority Data

Apr. 20, 2006 (ZA) ..... 2006/03139

(51) Int. Cl.
*F42C 17/04* (2006.01)

(52) U.S. Cl. ..... 102/217; 102/220

(58) Field of Classification Search ..... 102/217, 102/220

See application file for complete search history.

(56) References Cited

U.S. PATENT DOCUMENTS

| | | | | |
|---|---|---|---|---|
| 4,406,226 | A * | 9/1983 | Davitt et al. | 102/311 |
| 4,445,435 | A | 5/1984 | Oswald | |
| 4,586,437 | A | 5/1986 | Miki et al. | |
| 4,712,477 | A | 12/1987 | Aikou et al. | |
| 4,846,066 | A | 7/1989 | Beattie et al. | |
| 5,571,985 | A * | 11/1996 | Ritter et al. | 102/217 |
| 5,602,360 | A | 2/1997 | Sakamoto et al. | |

FOREIGN PATENT DOCUMENTS

| | | | |
|---|---|---|---|
| EP | 0 420 673 | A2 | 4/1991 |
| GB | 744531 | | 2/1956 |
| WO | WO 94/15169 | A1 | 7/1994 |
| WO | WO 95/10754 | A1 | 4/1995 |
| WO | WO 2005/008169 | A2 | 1/2005 |

* cited by examiner

*Primary Examiner* — Stephen M Johnson

(74) *Attorney, Agent, or Firm* — Quine Intellectual Property Law Group, P.C.; Monica Elrod-Erickson

(57) ABSTRACT

A detonator system which includes an array of a plurality of discrete time delay relays (16) connected in series to one another, and a plurality of detonators (28) which are respectively connected to the array at spaced intervals (22).

7 Claims, 11 Drawing Sheets

16
16B
16A
18
12
CIRCUIT
T1
20
22
16B
16A
30
CON.
32
34
14
T2
26
IGNI.
28
16
16B
16A
30
18
20
32
34
10
T2
26
IGNI.
28
36
28
36
44
44

V
48
44
t
N,T1
V
46
42
t
To

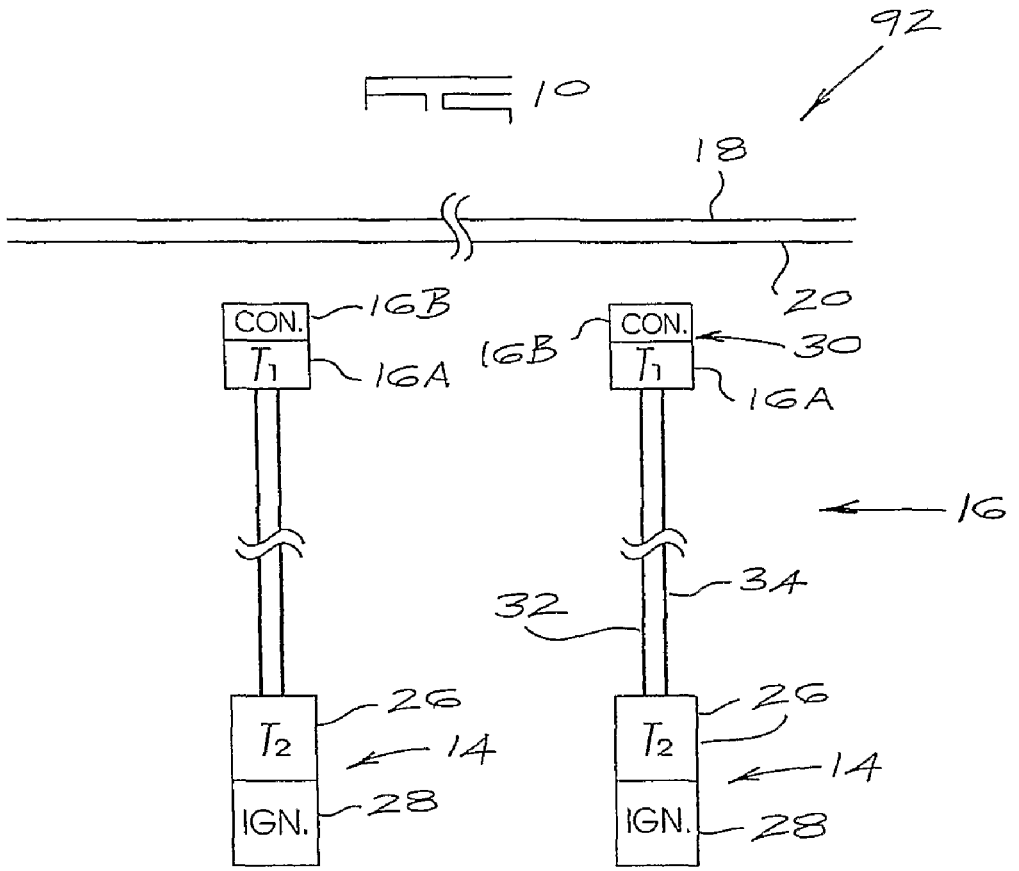
FIG 10
92
18
20
CON.
T1
16B
16A
16B
CON.
T1
30
16A
16
34
32
26
T2
14
IGN.
28
26
T2
14
IGN.
28
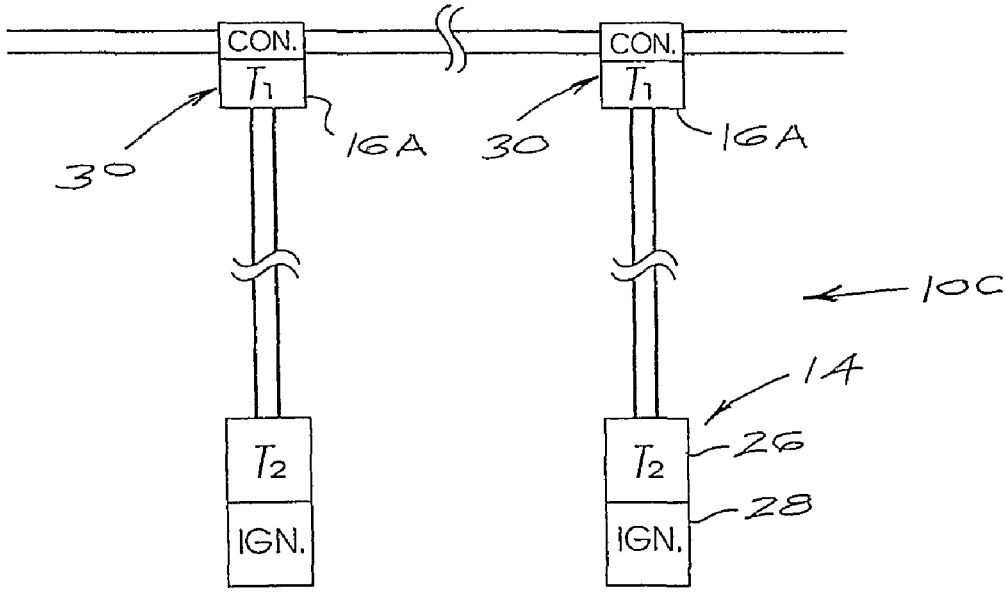
CON.
T1
30
16A
CON.
T1
30
16A
10C
14
T2
IGN.
T2
26
IGN.
28

DETONATOR SYSTEM

CROSS-REFERENCE TO RELATED APPLICATIONS

This application is a national phase entry in the United States under 35 U.S.C. §371 from International Application Number PCT/ZA2007/000021, which has an international filing date of Apr. 16, 2007, and which claims priority to and benefit of South African Patent Application Number 2006/03139, filed Apr. 20, 2006, the disclosures of which are incorporated herein by reference in their entirety for all purposes.

BACKGROUND OF THE INVENTION

This invention relates to a detonator system and to a time delay relay for use in a detonator system.

Different types of detonator systems exist. For example the use of shock tubes is well entrenched. Essentially a shock tube propagates an initiating signal at a predictable speed to detonators which are connected at intervals to the shock tube. The propagation speed and a designed pyrotechnic delay inside each detonator determine the duration of each time interval between the times at which the initiating signal is applied to one detonator and to a following detonator.

Although a shock tube system works effectively it does suffer from disadvantages. It is not easily possible to determine, precisely, the duration of the time delay between successive detonators. Another factor is that it is not possible to test the integrity of a shock tube detonator system without initiating the various detonators.

It is also known to make use of timing systems which are electrically based to determine the duration of each time delay. Electronic systems which are implemented through the use of integrated circuits are also in use. Generally however an electronically-based detonator system is relatively expensive and the cost thereof cannot easily be justified unless highly accurate time delay periods are required. A further factor is that the complexity of this type of system can generate user resistance.

With an electrically-based system connections between successive detonators are effected by means of elongate electrical conductors or wires. This type of system usually works at a low voltage and if a wire is damaged, an incident which can easily occur in the rough conditions which pertain at many blasting sites, electrical leakage can occur. This increases the potential unreliability of the system. If a high voltage could be used then the effect of electrical leakage would be reduced. However for safety and other reasons high voltages are not used, at least for testing purposes, in an electronically-based blast installation.

U.S. Pat. No. 4,445,435 describes a detonator blasting circuit which includes a capacitor which is charged by an input signal and which then powers a timing circuit to determine a time delay. Generally similar approaches are disclosed in U.S. Pat. Nos. 4,586,437, 4,712,477 and 5,602,360. In each instance the delay between each set of successive blasts is fixed only by the programmed time delays of the respective timing circuits. This means it is necessary to keep track of the geographical position of each detonator and once all the detonators have been placed in their respective boreholes, to program the appropriate time delays into the respective detonators.

SUMMARY OF INVENTION

The invention is concerned, in the first instance, with a detonator system which addresses at least partly some of the aforementioned factors.

The invention provides a detonator system which includes an array of a plurality of discrete time delay relays connected in series to one another, and a plurality of detonators which are respectively connected to the array at spaced intervals.

The detonator system may be implemented in various ways. In one form of the invention each time delay relay includes a respective connector and the plurality of detonators are respectively connected to a plurality of the connectors.

In a different form of the invention each detonator is connected to the array between a respective adjacent pair of time delay relays.

The detonator system may include elongate electrical conductors between each adjacent pair of time delay relays. However any other suitable connection devices may be used between adjacent time delay relays.

According to requirement the connection devices (eg. electrical connectors) could be used to transfer electrical energy and signals, to each time delay relay. If the connection devices are optically based, e.g. fibre optic cables, then signals only, as distinct from meaningful energy, are transferred to each time delay relay.

The invention is not restricted by the nature of the connection devices.

The time delay relays can be provided at regularly spaced intervals, determined according to requirement, along the length of the electrical conductors. Alternatively the time delay relays can be provided, initially as unconnected devices, and each time delay relay could then be connected to the electrical conductors at a respective chosen location. This aspect would generally be determined by the nature of the site at which the detonator system is to be used.

Each time delay relay may be constructed to produce a signal after a predetermined time delay period. In order to vary the duration of the time delay period between adjacent pairs of detonators the invention provides, according to requirement, that one or more time delay relays can be bridged out, i.e. bypassed, or that one or more additional time delay relays can be connected to the electrical conductors.

Each time delay relay can be provided in any appropriate way and can be constructed using any suitable technique. Preferably, though, use is made of electronic techniques, and provision is made for a storage or memory area or location for storing data such a required time delay, or an identifier which could uniquely identify the time delay relay, or identify the relay as belonging to a particular class or type of time delay relays.

The invention extends, in the second instance, to a time delay relay which includes a voltage sensor which, in response to a first signal which has a voltage of a defined magnitude, produces an output signal, a time delay element which in response to the output signal commences timing of a defined time period, and a switch which is operated at the end of the defined time period.

The switch, upon operation, may generate an output signal which is substantially the same as the first signal but which is delayed in time by the duration of the defined time period.

The time delay relay may further include a decoder for validating the first signal so that the voltage sensor is only responsive to the first signal if the first signal is validated.

The invention also extends to an electronic delay line for use in a detonator system which includes a plurality of time delay relays of the kind described connected to one another in a series array and wherein the switch of one time delay relay is connected to the voltage sensor or the decoder, as the case may be, of the following time delay relay.

BRIEF DESCRIPTION OF THE DRAWINGS

The invention is further described by way of examples with reference to the accompanying drawings in which:

FIGS. 8 to 11 illustrates different ways in which the principles of the invention can be used.

DESCRIPTION OF PREFERRED EMBODIMENTS

Figure 1:
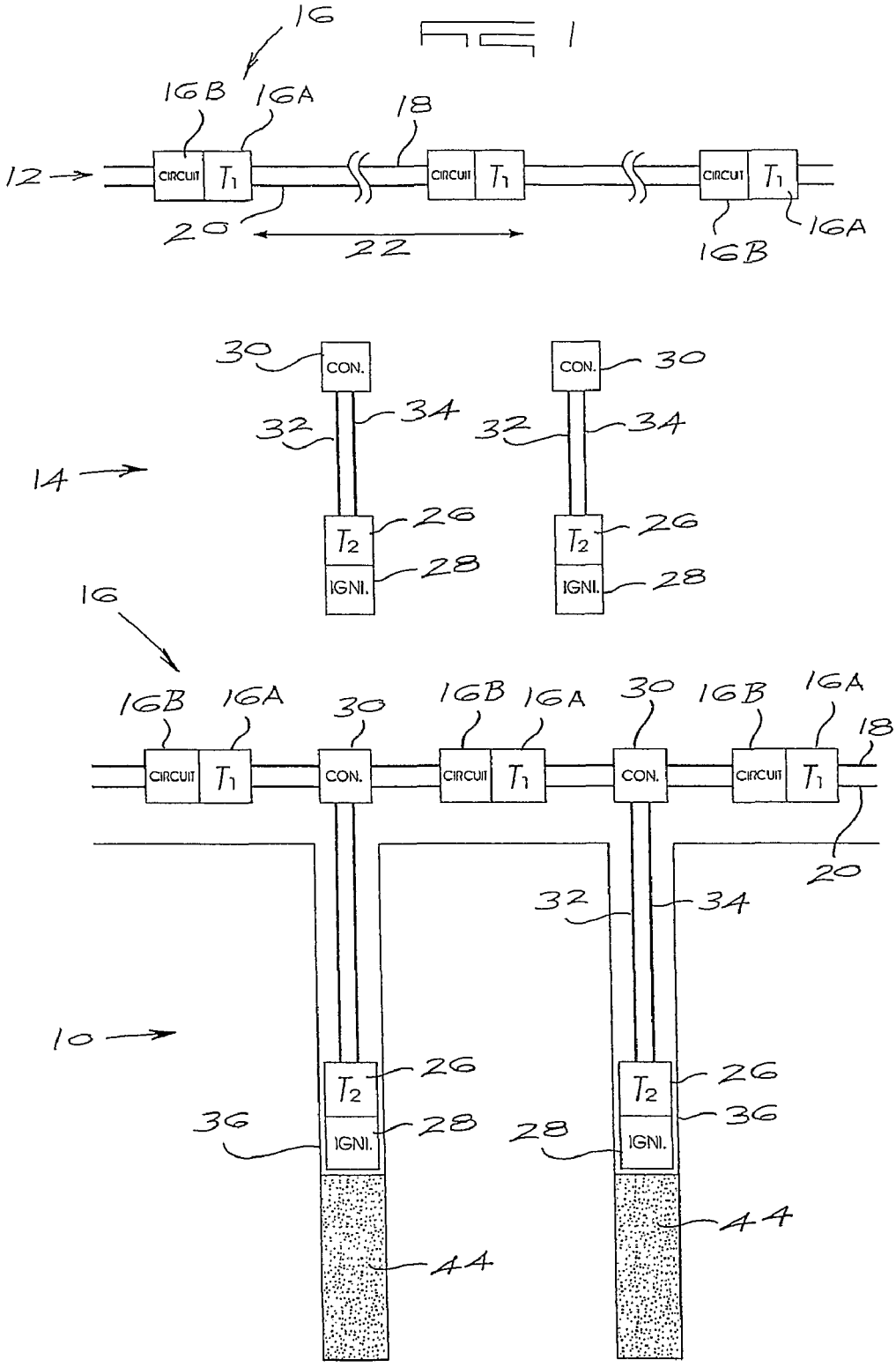
FIG. 1 illustrates a detonator system according to a first form of the invention.

FIG. 1 of the accompanying drawings has three parts which respectively illustrate a detonator system 10, an electronic delay line 12 and a plurality of time delay detonators 14.

The delay line 12 includes a plurality of time delay relays 16, each of which has a respective timer 16A and a control circuit 16B, connected to elongate electrical conductors or wires 18 and 20 of indeterminate length. The time delay relays are spaced from each other along the length of wires 18 and 20 by fixed intervals 22. The length of each interval 22 is determined according to requirement and for example may be 2 m, 4 m or any other chosen length. The magnitude of the interval 22 is not important to an understanding of the invention, but is important from a practical point of view during use.

Each time delay detonator 14 includes at least a time delay element 26 and an ignition device 28. Control and communication circuitry of any suitable kind, as is known in the art, can be embodied in each detonator according to requirement. The detonator is connected to a connector 30 by means of electrical wires 32 and 34.

The detonator system 10 is constructed from a delay line 12 and a plurality of the time delay detonators 14 by connecting the various connectors 30 to the wires 18 and 20 at selected locations. In general terms it can be said that, in a blasting installation, the delay line 12 will extend along a convenient path on surface from borehole to borehole and the connectors 30 will be connected to the wires 18 and 20 so that the wires 32 and 34 extend from the respective connector 30 into an associated borehole 36 in which the detonator 14 is placed. The ignition device 28 of the detonator is exposed to explosive 44 in the borehole.

In one implementation of the invention each time delay relay 16 is designed to produce, by means of its timer 16A, a precisely determined time delay period $T_1$. Each time delay element 26 produces a precisely determined time delay period $T_2$.

Figure 2:
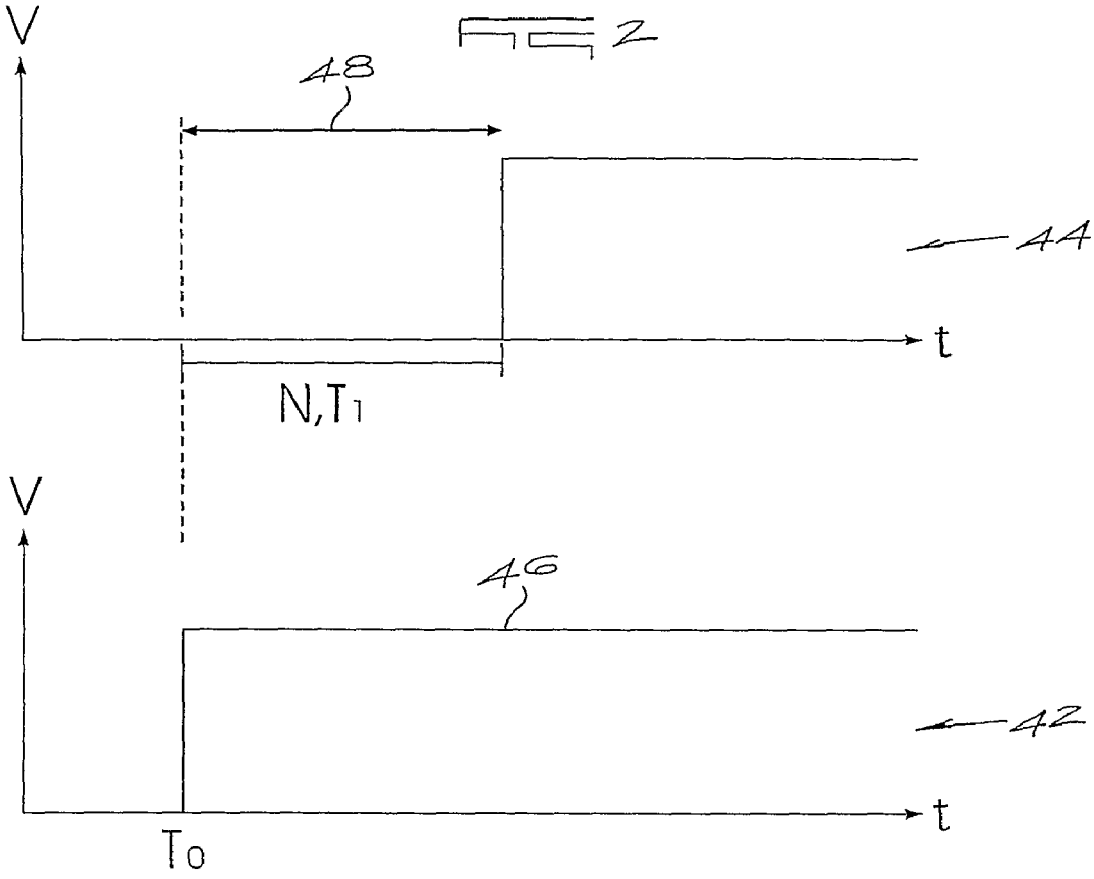
FIG. 2 contains timing diagrams of voltages in the detonator system of the invention.

FIG. 2 includes two graphs 42 and 44 respectively of voltage vs. time. The graph 42 illustrates a voltage waveform 46 of step shape which is impressed on the delay line 12, at a chosen location, at time $T_0$. The voltage waveform propagates down the delay line at a speed which is determined by the time delay periods $T_1$. This aspect is further described hereinafter with reference, for example, to FIGS. 3 and 4. As each time delay relay produces a time delay period $T_1$ the waveform is impressed on the delay line 12 at a location which is spaced by N time delay relays from the starting point, after a time interval 48 which is equal to $N \times T_1$. In other words the electronic delay line 12 has a modular approach to the production of time delays and, typically, the total time delay between any two points on the delay line is variable in steps and not continuously. By varying the number of time delay relays 16, with each relay producing a precisely determined time period, between spaced points on the wires 18 and 20, it is possible to produce a succession of accurately predetermined time delay periods along the delay line on surface, and to retain the facility of programming each detonator in a borehole with a chosen time delay, or of using detonators which are preprogrammed with chosen time delays.

Figure 3:
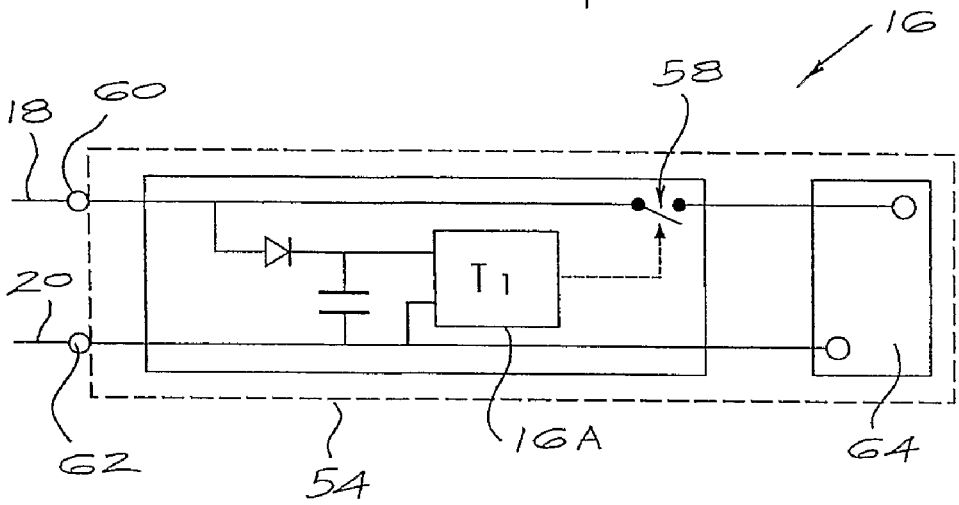
FIG. 3 depicts components for use in the detonator system of the invention.
Figure 3:
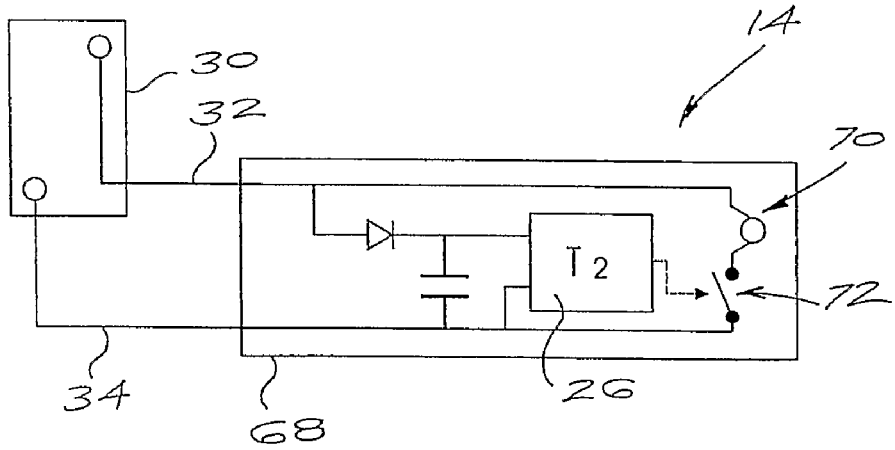

FIG. 3 shows possible further details of a time delay relay 16 and of a time delay detonator 14.

The time delay relay can be packaged in any appropriate manner, indicated symbolically by means of a dotted line 54. The relay includes an integrated circuit timer 16A which produces the required time delay period $T_1$, a high efficiency electronic switch 58 such as a low loss FET switch, input terminals 60 and 62 to which the wires 18 and 20 are respectively connected and an output connector 64.

The detonator 14 includes, as noted, a connector 30. This can be connected in only one manner, when required, to the connector 64. The time delay element 26 is enclosed in a suitable housing 68 and the wires 32 and 34 extend from the connector 30 to the housing. A fuse head 70 of any appropriate design is connected in line to an electronic switch 72 such as a silicon controlled rectifier or an FET, which is operable by means of the timer 26.

If a voltage of suitable magnitude is impressed on the terminals 60 and 62 then the timer 16A is actuated and commences the timing of the predetermined time interval $T_1$. This is usually carried out on surface and not in a borehole. At the end of that interval the switch 58 is closed and the voltage on the terminals 60 and 62 is then impressed on the wires 32 and 34. The timer 26 then commences its timing interval $T_2$ and at the end thereof the switch 72 is closed and the fuse head 70 is initiated.

Figure 4:
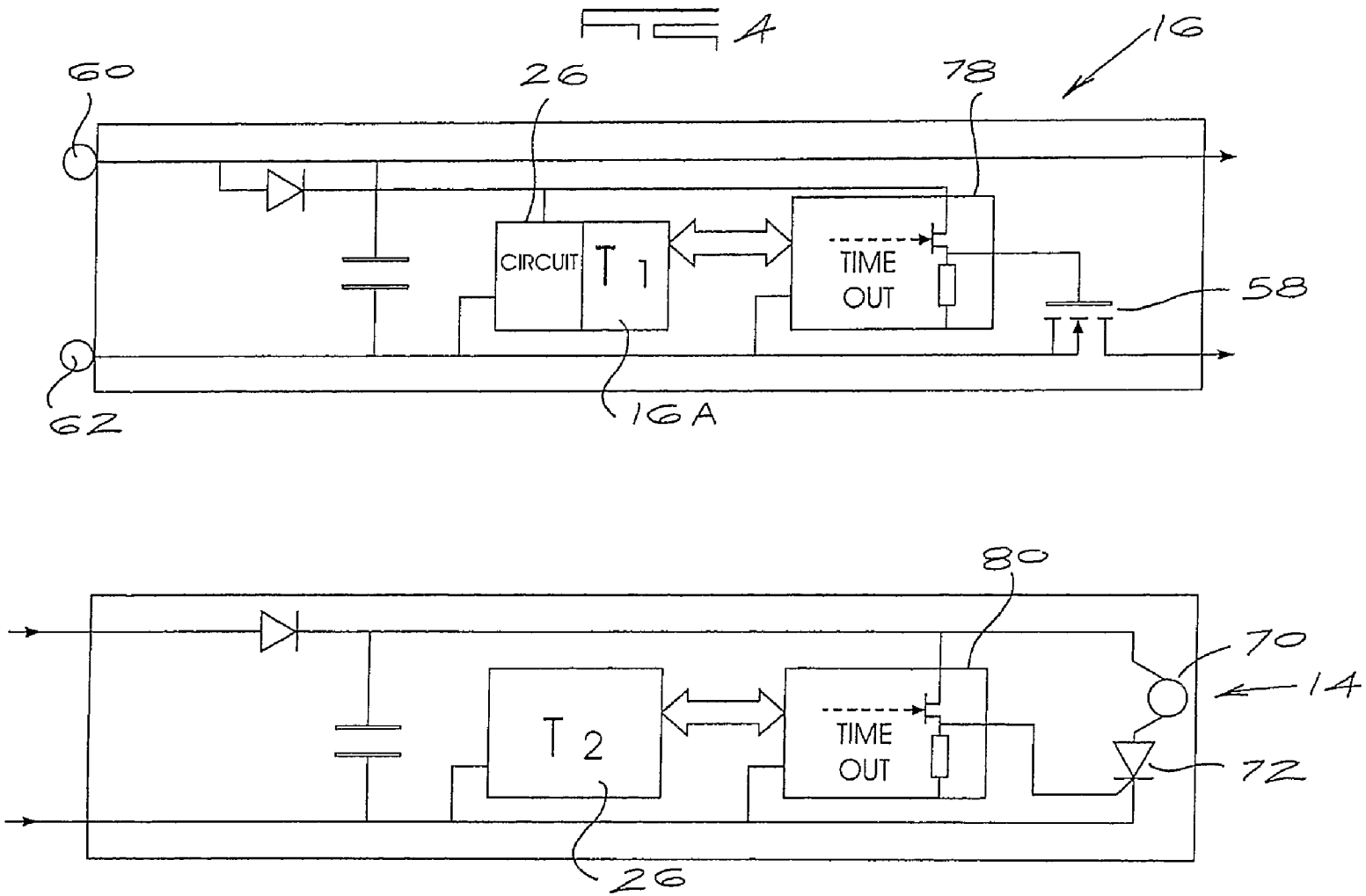
FIG. 4 depicts components according to a variation of the invention for use in a detonator system of the invention.

FIG. 4 shows a time delay relay 16 which includes an input sensor circuit 76 which detects the magnitude of a voltage impressed on the input terminals 60 and 62. If the magnitude of the voltage is above a predetermined value then the timer 16A is actuated and commences timing of the predetermined time delay period $T_1$. At the end of the period a signal is transmitted to a timeout circuit 78 and the switch 58 is closed. A signal is then transmitted to a detonator 14. This signal could alternatively or additionally be transmitted to one or more time delay relays, each similar to the relay 16, in a blast installation.

The detonator 14 has a circuit 80 which is similar to the timeout circuit 78, and a timer 26. The circuit 80, upon detecting the voltage signal which is output upon closure of the switch 58, causes the timer 26 to commence the timing of its time delay period $T_2$. At the end of this period a signal is sent to the circuit 80 and the switching device 72 is closed to fire the fuse head 70.

Figure 5:
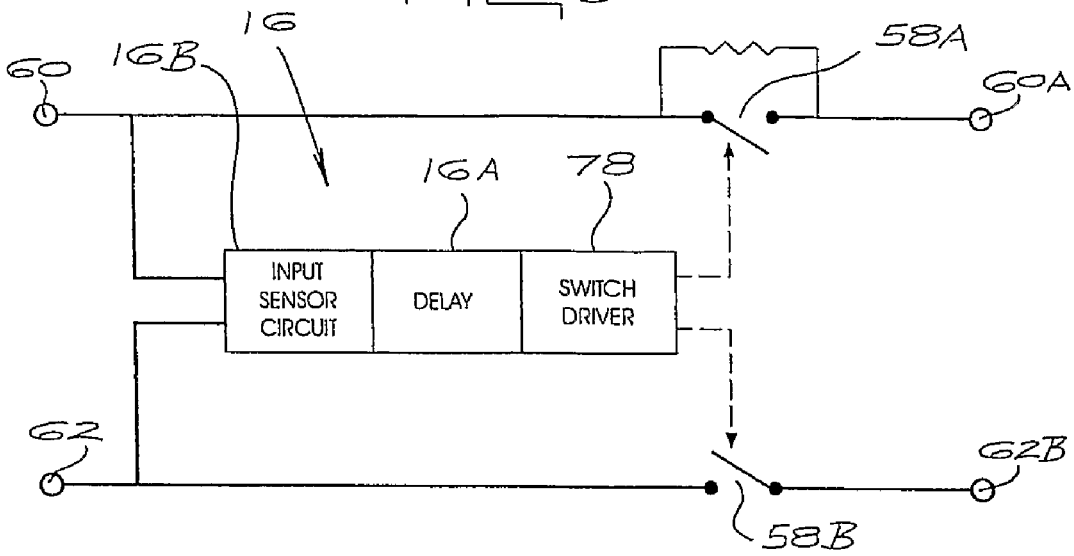
FIGS. 5 and 6 are block diagram representations of different time delay relays according to the invention.

FIG. 5 is a functional block diagram representation of the time delay relay 16 shown in FIG. 3. A circuit 16B senses the magnitude of a voltage input at the terminals 60 and 62. In response thereto the timing of a delay is initiated by a delay circuit 16A and at the end of the time delay period a switch driver (timeout circuit) 78 is actuated to cause the closure of switches 58A and 58B at output terminals 60A and 62B of the time delay relay.

Figure 6:
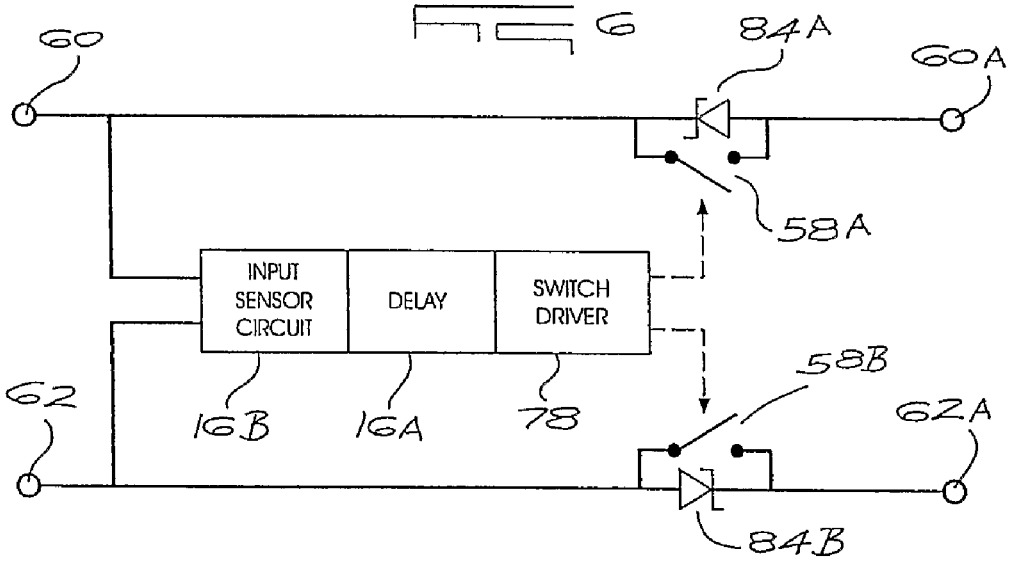
Figure 6:
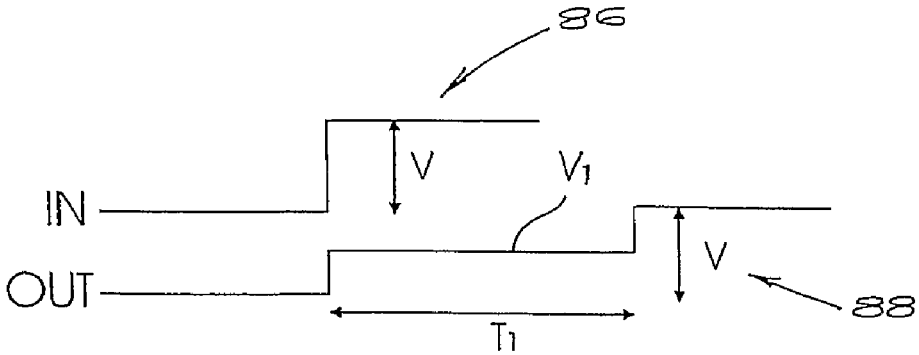

FIG. 6 depicts a variation to the configuration in FIG. 5 wherein each switch 58A and 58B is bridged by a respective zener diode 84A and 84B. An input step voltage waveform 86 of magnitude V (shown below the circuit) is applied to the time delay relay which then produces an output voltage waveform 88. If the trigger threshold of the input sensing circuit 16B is about V/2 then, initially, a voltage $V_1$ is presented at the output terminals 60A and 62A which is determined by the breakdown voltage of the zener diodes and, at the end of the timing interval $T_1$, the voltage at the output terminals rises to the magnitude of the input voltage i.e. V. $V_1$ should be significantly lower than the trigger threshold voltage, and serves mainly a preconditioning function in that it reduces ramp-up time and subsequent voltage jitter.

Figure 7:
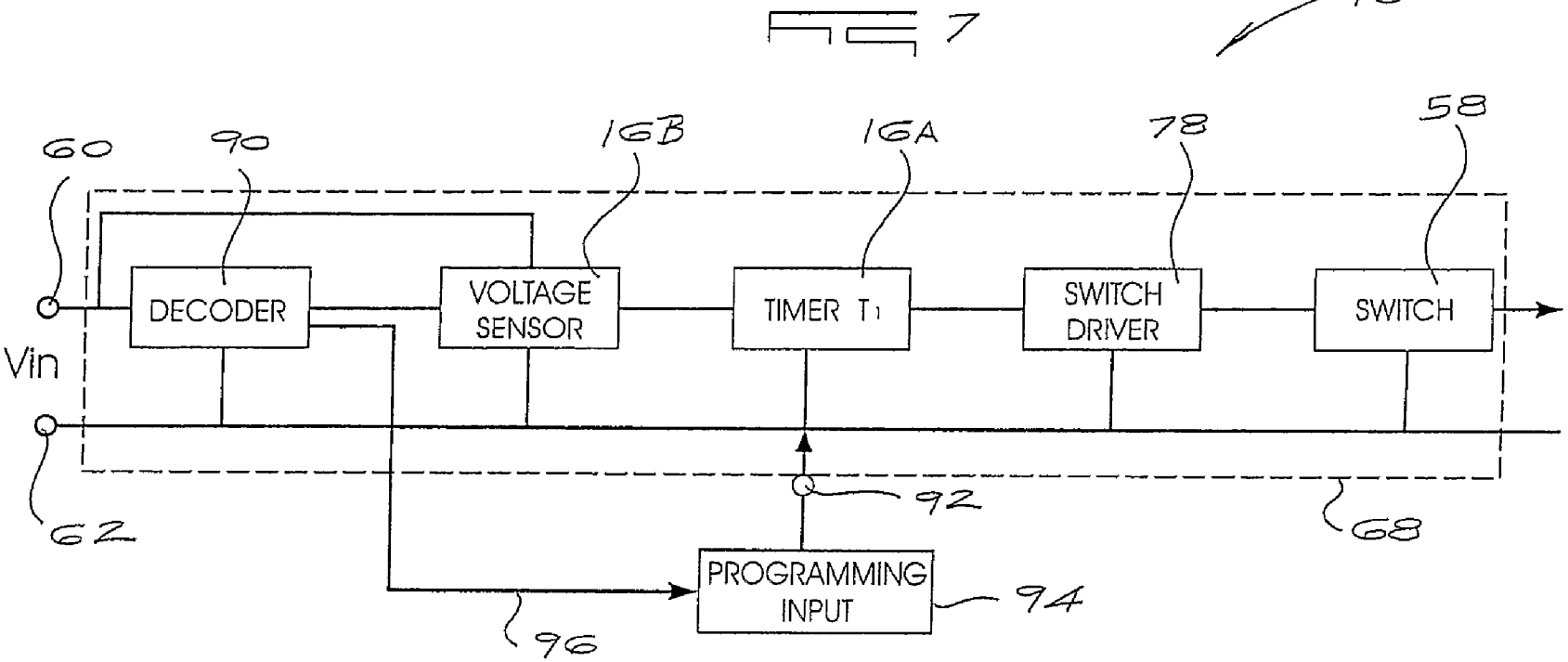
FIG. 7 depicts further possible variations in the time delay relay of the invention.

FIG. 7 illustrates a time delay relay which includes a voltage or input sensor circuit 16B, a delay timer 16A, and a switch driver 78 which is connected to one or more output switches 58. These elements are held in a housing 68. A decoder 90 is also included in the housing. If an input voltage signal $V_{in}$ is impressed on the input terminals 60 and 62 then the decoder 90 undertakes a validation process of the signal. If the input voltage is correctly encoded then the voltage sensor 16B is enabled. The function of the time delay relay is then similar to what has been described. Thus the circuit functions only if a correctly encoded word is detected.

Another possible modification is to provide an input 92 to the timer 16B which allows a programming unit 94 to be connected to the timer. In this way the duration of the timing interval $T_1$ can be varied according to requirement. A lead 96 from the decoder 90 to the unit 94 can be used to provide a serial programming interface from the terminals 60 and 62, also to vary the duration of $T_1$.

The aforementioned inventive concepts can be implemented in various ways.

Figure 8:
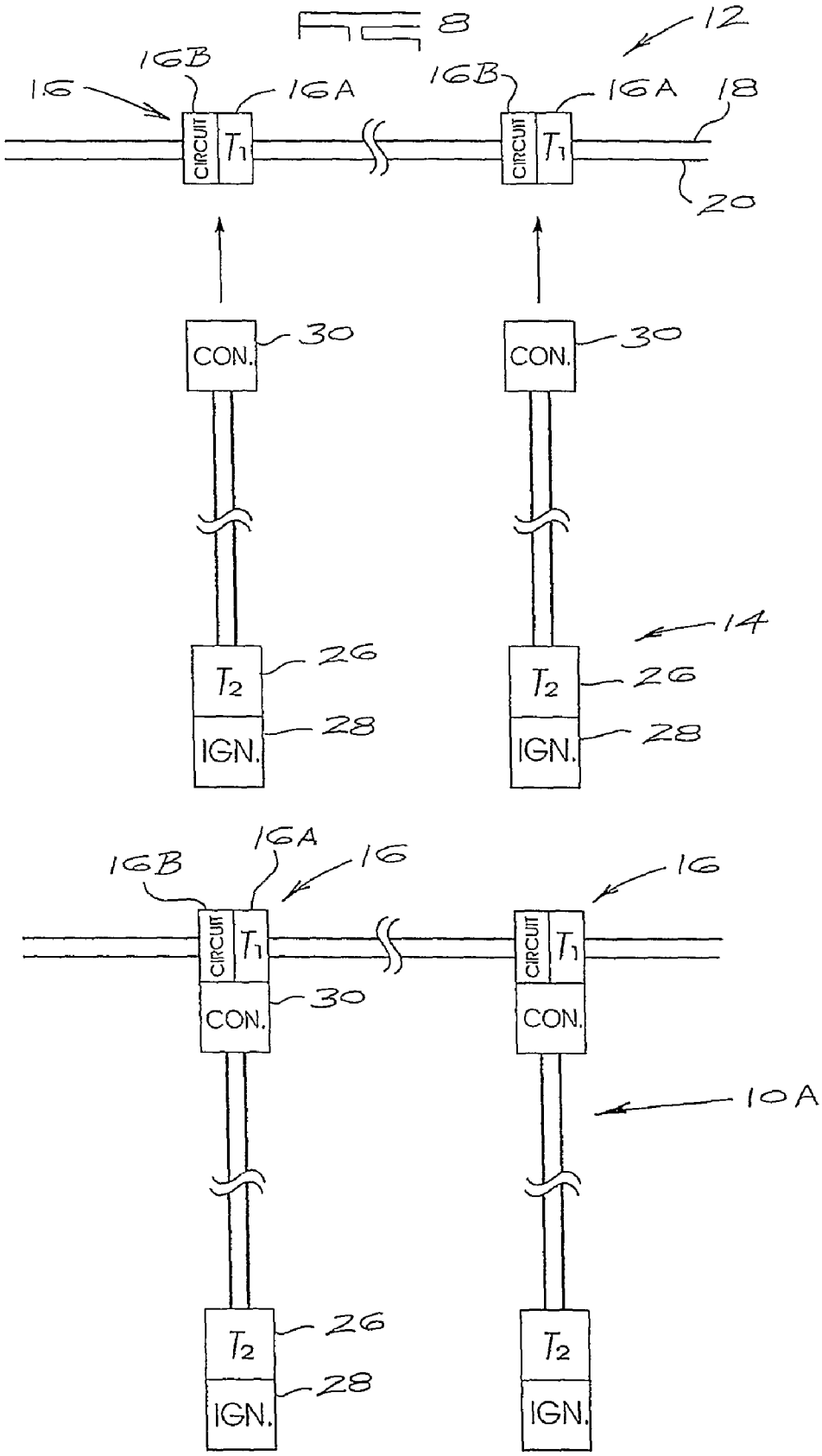

FIG. 8 shows a detonator system 10A, an electronic delay line 12 and detonators 14 similar to what are shown in FIG. 1. Like components bear like reference numerals. The line is fabricated under factory conditions and the time delay relays 16 are connected to the wires 18 and 20 in accordance with a predetermined pattern.

The detonators 14 are however connected to the time delay relays, and not to the wires between adjacent pairs of time delay relays, to provide a detonator system 10A which functions in the manner which has been described and possesses similar advantages.

Figure 9:
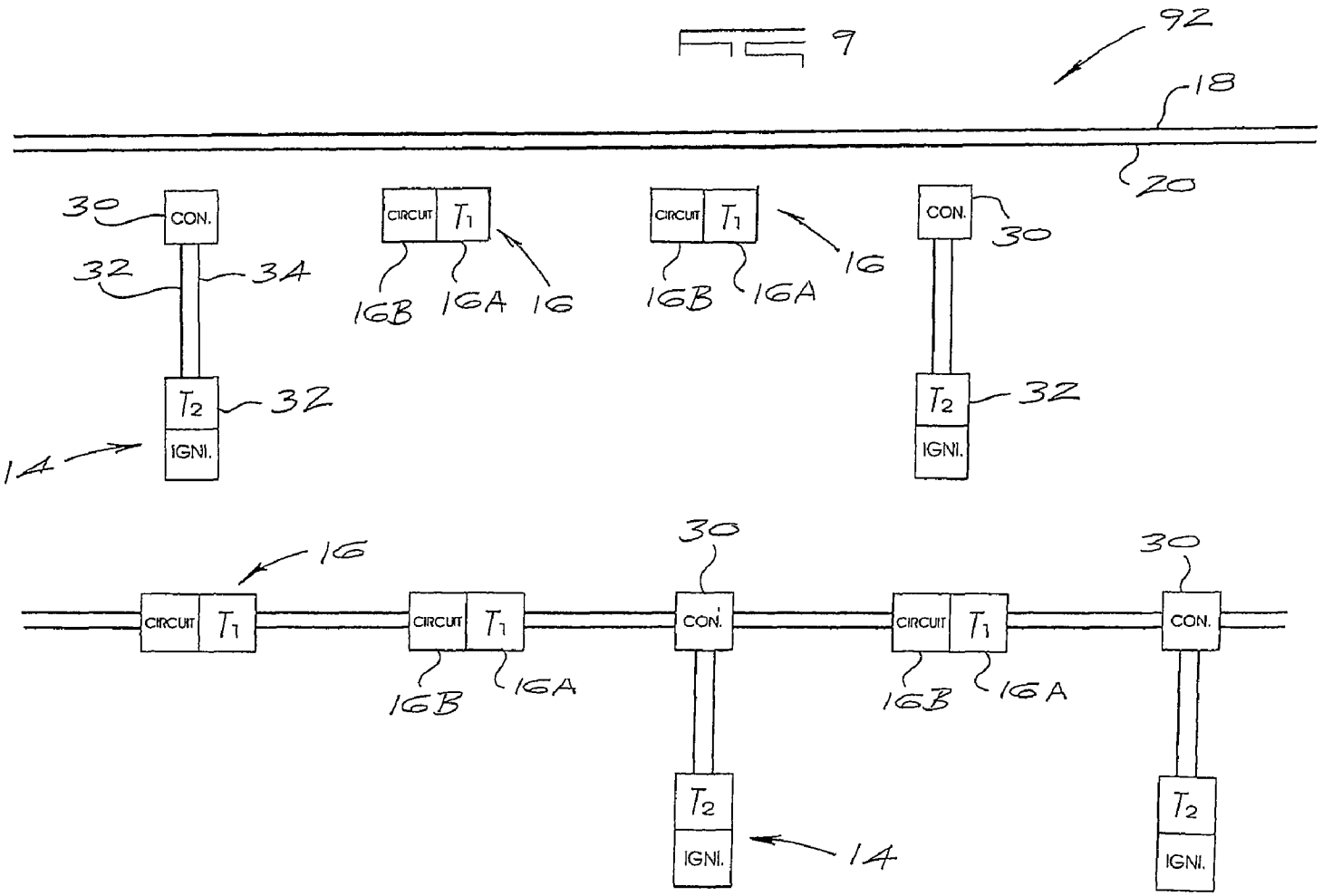

FIG. 9 shows a conductor 92 which includes wires 18 and 20. Separate time delay relays 16 which are fabricated under factory conditions are provided to a user together with time delay detonators 14. The time delay relays 16 are connected to the wires 18 and 20, as required, between adjacent pairs of detonators 14. The time delay between adjacent pairs of detonators is varied in multiples of the basic time delay interval $T_1$ produced by an individual time delay relay 16.

FIG. 10 shows a conductor 92 which includes wires 18 and 20. The conductor is used with detonators 14 each of which is connected by means of wires 32 and 34 to a respective connector 30. Integrally housed within the connector 30 is a time delay relay 16 which produces a time delay interval $T_1$ in the manner which has been described. When the detonators 14 are connected to the conductor 92, as is shown in the lower half of FIG. 10, a detonator system 10C is produced which provides fixed time delay intervals $T_1$ between adjacent detonators and wherein each detonator, in turn, provides a predetermined time delay period $T_2$, in the manner which has been described.

Figure 11:
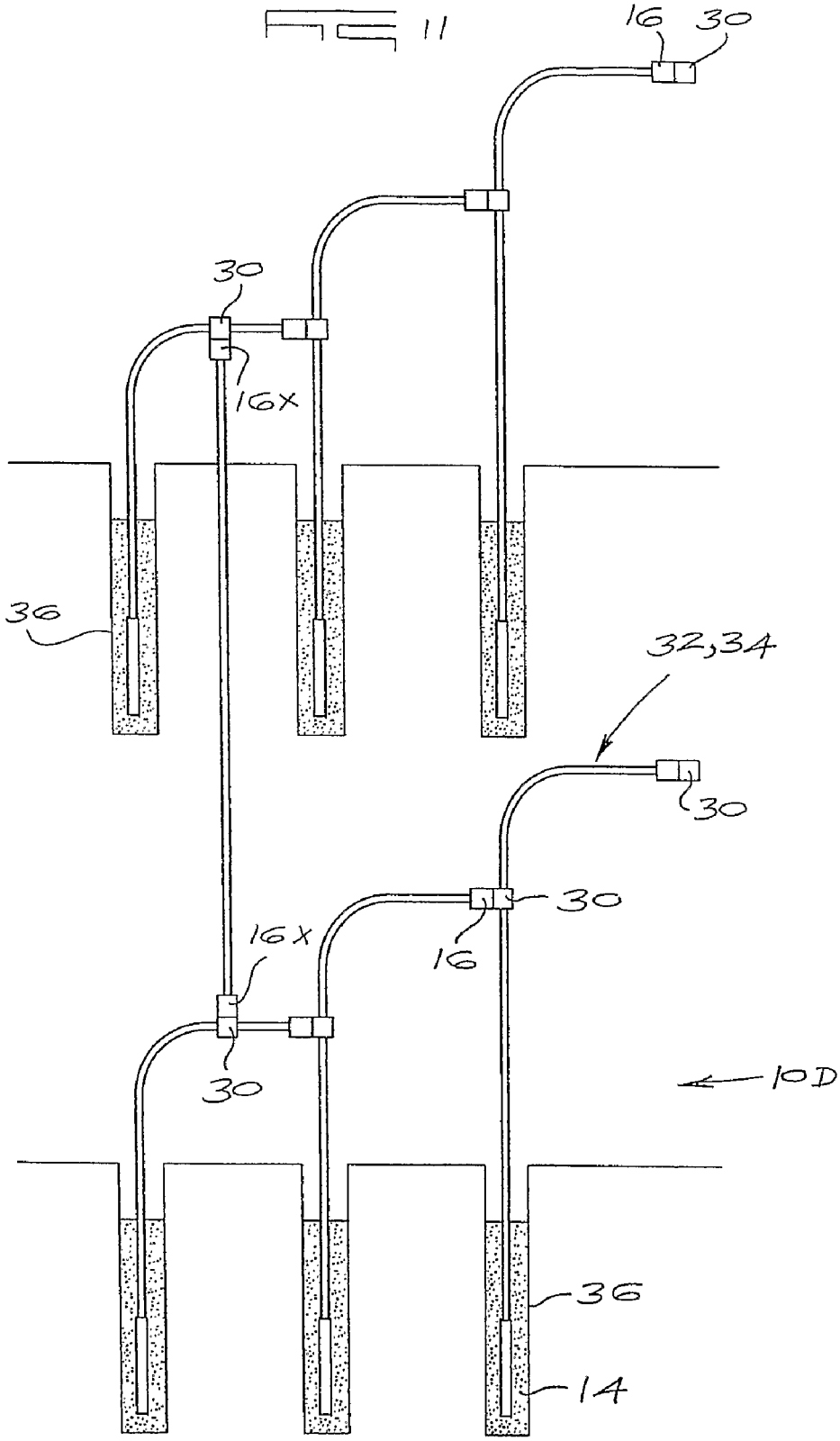

FIG. 11 illustrates a detonator system 10D which includes a plurality of detonators 14 wherein each connector 30 incorporates or houses a respective time delay relay 16. The connector 30 can be connected to the wires 32 and 34 of another detonator at any chosen position.

The detonators can be linked in succession directly to one another by clipping a connector 30 of one detonator onto the wires 32 and 34 of an adjacent detonator. The detonators are positioned, as required, in boreholes 36. With this arrangement there is no distinct bus or main line for each set of wires fulfils a main line and a branch line function. Adjacent strings or branch lines of detonators can also be connected as required, to each other, by using connectors 30, optionally with integral time delay relays 16X.

Figure 12:
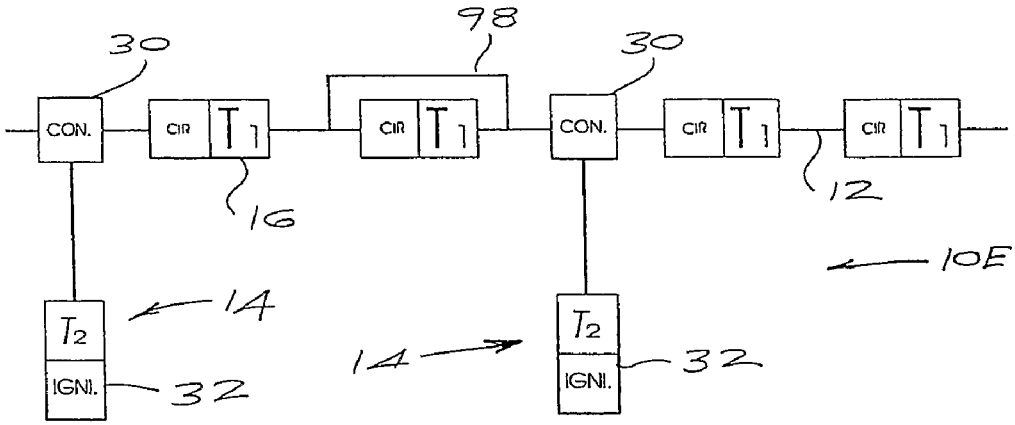
FIGS. 12 and 13 illustrate possible further modifications which can be implemented in a detonator system according to the invention.

FIG. 12 shows a detonator system 10E wherein time delay relays 16 are positioned between detonators 14 along the length of a delay line 12. In this instance there are two time delay relays 16 between each adjacent pair of detonators. In order to vary the delay period it is possible to use a bridge connection 98 across a chosen time delay relay. The bridge connection short circuits the respective time delay relay and directly connects its input line to its output line. The timing effect of the time delay relay 16 in question is then negated.

Figure 13:
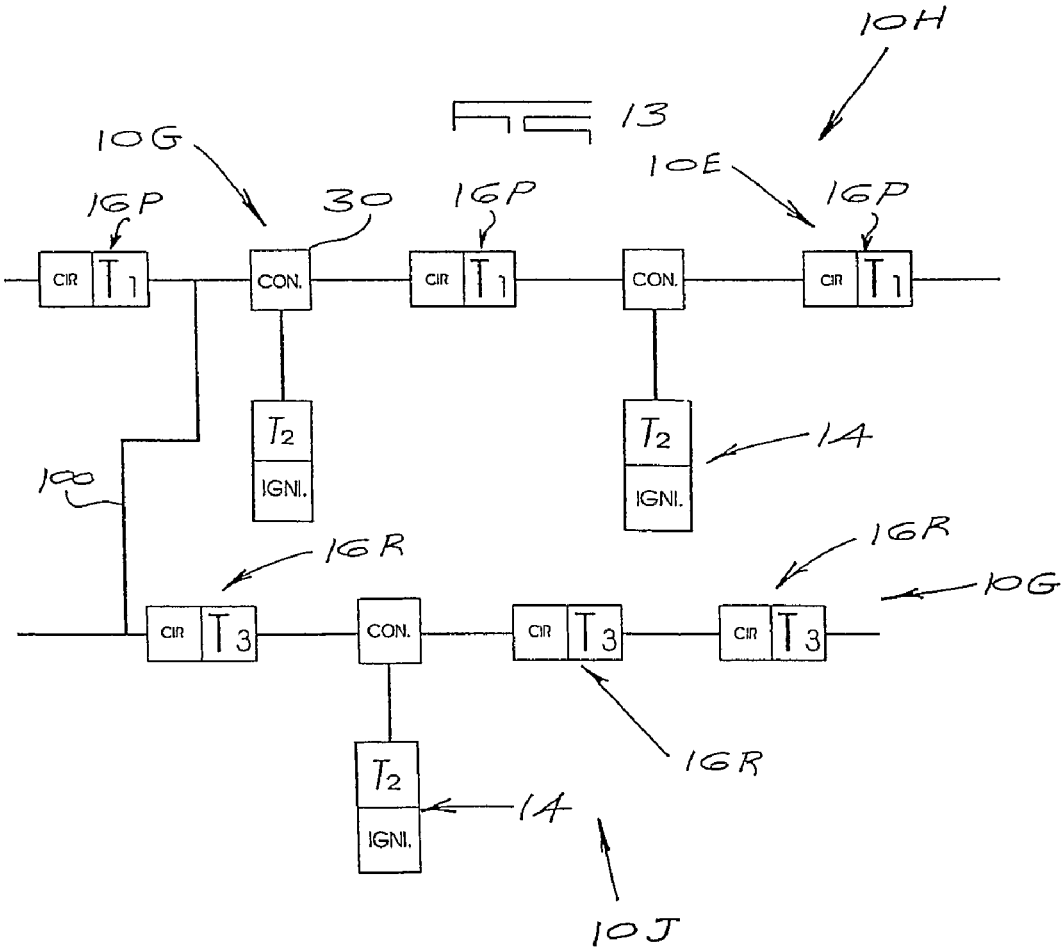

FIG. 13 shows a compound system 10G which includes a first section designated 10H in which time delay intervals $T_1$ are generated by time delay relays 16P. A branch line 100 connects the section 10H to a second section 10J in which time delays $T_3$ are generated by time delay relays 16R. Clearly this process can be continued, as required.

The invention holds a number of important benefits. The delay line 12 which comprises a bus conductor with multiple discrete time delay relays can be tested under factory conditions to ensure continuity and the effective switching of energy and of signals, from one end to the other end of the line. In an actual installation current impressed on the delay line can be modulated by means of suitable circuitry incorporated in the last time delay element to show that full connectivity has been achieved.

It is possible to include a light or buzzer or other signaling device at an end of the delay line to indicate full connectivity has been achieved before the detonators 14 are coupled to the delay line.

A particular advantage arises in that the system makes it possible to use a voltage waveform, whether encoded or not, with a high amplitude e.g. of the order of 50V. This high voltage overcomes the problem of leakage referred to in the preamble to this specification.

Although in one respect the system of the invention is similar to a shock tube based system it has the advantage that it offers a security feature on a blast command in that the system can be made inoperative in the absence of a security word or command. Also, the time delay function is implemented in two stages i.e. in a first stage, typically on surface, by the time delay relays, and in a second stage, typically within each borehole, by using a pre-programmed detonator or by programming an installed detonator.

Compared to a traditional four-wire electronic delay blasting arrangement the system of the invention offers flexibility in connection and the use of less wire.

The invention claimed is:

1. A detonator system which includes a delay line which is formed from a plurality of discrete electronic time delay relays, each time delay relay producing a respective output signal a predetermined time delay period after application of an input signal to the time delay relay, and elongate connection devices between each adjacent pair of time delay relays whereby the time delay relays are connected in series to one another so that an output signal from a first time delay relay is applied as an input signal to a second time delay relay which is adjacent the first time delay relay, and a plurality of detonators which are respectively connected to the delay line at spaced intervals, wherein each time delay relay includes a voltage sensor which, in response to an input signal which has a voltage of a defined magnitude, produces an actuating signal, a decoder for validating the input signal so that the voltage sensor is only responsive to the input signal if the input signal is validated, a time delay element which in response to the actuating signal commences timing of the predetermined time delay period, and a switch which is operated at the end of the predetermined time delay period to produce an output signal of that time delay relay which is applied as an input signal to an adjacent time delay relay.

2. A detonator system according to claim 1 wherein each time delay relay includes a respective connector and the plurality of detonators are respectively connected to a plurality of the connectors.

3. A detonator system according to claim 1 wherein each detonator is connected to the delay line between a respective adjacent pair of time delay relays.

4. A detonator system according to claim 1 wherein the elongate connection devices are elongate electrical conductors between each adjacent pair of time delay relays.

5. A detonator system according to claim 1 wherein the time delay relays are provided at regularly spaced intervals in the delay line.

6. A detonator system according to claim 1 wherein each time delay relay includes a memory for storing data selected from a required time delay and an identifier which uniquely identifies the time delay relay or which identifies the relay as belonging to a particular class or type of time delay relays.

7. A detonator system according to claim 1 wherein the output signal, produced upon operation of the switch, is substantially the same as the input signal but is delayed in time by the duration of the predetermined time delay period for that time delay relay.

* * * * *